US005744906A

United States Patent [19]

Alford et al.

[11] Patent Number: 5,744,906

[45] Date of Patent: Apr. 28, 1998

[54] GAS DISCHARGE ILLUMINATION DEVICE

[76] Inventors: Warren L. Alford, 2110 Stapp Dr., NE., Huntsville, Ala. 35801; Danny Ray Massey, 5956 Brookline La., Montgomery, Ala. 36116

[21] Appl. No.: 577,134

[22] Filed: Dec. 22, 1995

[51] Int. Cl.[6] ..... H01J 61/30

[52] U.S. Cl. ..... 313/493; 313/515; 313/634; 313/113

[58] Field of Search ..... 313/493, 515, 313/573, 609, 612, 634, 113; 40/545, 546, 558, 583

[56] References Cited

U.S. PATENT DOCUMENTS

| | | | |
|---|---|---|---|
| 1,720,155 | 7/1929 | Thomas | 313/515 |
| 1,825,399 | 9/1931 | Hotchner | 313/634 X |
| 1,923,148 | 8/1933 | Hotchner | 313/634 X |
| 1,937,957 | 12/1933 | Hotchner | 313/634 X |
| 2,621,430 | 12/1952 | Neville | 313/634 X |
| 3,026,436 | 3/1962 | Hughes | 313/485 X |
| 4,234,817 | 11/1980 | Teshima et al. | 313/634 X |
| 4,454,448 | 6/1984 | Roberts | 313/493 |
| 4,584,501 | 4/1986 | Cocks et al. | 313/515 X |
| 4,703,574 | 11/1987 | Garjin | 40/545 |
| 4,990,826 | 2/1991 | Cocks et al. | 313/493 |
| 5,036,243 | 7/1991 | Cocks et al. | 313/515 X |
| 5,220,249 | 6/1993 | Tsukada | 313/493 X |
| 5,223,262 | 6/1993 | Lynn et al. | 313/493 X |
| 5,479,071 | 12/1995 | Lynn | 313/515 X |

*Primary Examiner*—Ashok Patel

*Attorney, Agent, or Firm*—John C. Garvin, Jr.; James E. Staudt

[57] ABSTRACT

A translucent longitudinally extending gas chamber housing having two sections, each of which includes a facial surface configured to congruently match the facial surface of the other. The sections are hermetically joined to one another at the facial surfaces thereof to form a chamber for the retention of an illuminating gas therein. Electrodes are provided where desirable within the chamber for ignition of the gas. The sections are configured for mass production typically by use of molding processes. Typically the sections include transitions from a raised portion to a flattened portion or vice versa to provide the configuration necessary for forming alphanumeric or other types illuminated of displays.

10 Claims, 5 Drawing Sheets

GAS DISCHARGE ILLUMINATION DEVICE

TECHNICAL FIELD OF THE INVENTION

This invention relates to the configuration of the longitudinal generally tubular elements utilized in the construction of gas-discharge illumination devices commonly referred to as neon signs or lights.

BACKGROUND OF THE INVENTION

For many years improvements have been made in gas-discharge type illuminated signs. These improvements have generally been directed to brightness, formation of individual letters for use on signs, efficiency of use and the like. Some devices have incorporated rectangular interfaced flat plates wherein portions of the interfaced plates were removed to form letters therein. Examples of prior art devices are found in the following U.S. Pat. Nos. 1,720,155; 3,026,436; 4,584,501; 4,703,574; 5,036,243; and 4,990,826. In the past the longitudinal generally tubular elements utilized in the construction of gas- discharge illumination devices have typically been formed from seamless cylindrical glass tubes which were heated at bending points and bent into the desired shapes by hand. Usually one half or more of the tubing was then manually blacked out to limit illumination to desired portions of the display. It is readily apparent that utilization of glass tubes of this type has many shortcomings, the most glaring of which is the fact that they cannot be mass produced by the many available modern techniques. Other shortcomings include the fact that while glass is suitable for certain applications, its fragility renders it quit unacceptable for applications wherein great strength or flexibility is required. The use of any seamless cylindrical tubing also creates a great deal of difficulty in placing electrodes inside the length of the tubing. As a result, electrodes were typically found only at the terminal ends of the tubing. This is a considerable disadvantage since placement of electrodes inside the length of the tubing permits an almost infinite number of special effect illumination options. Other special effects which involve reforming the surface of the glass such as etching were typically done manually and were difficult and costly to accomplish. Of the patents listed above the U.S. Pat. Nos. 3,026,436; 4,584,501; 4,703,574; 5,036,243 are directed to the use of rectangular plate signs of the type mentioned above. The indicia disclosed in these patents are formed by removal of material from transparent plates which plates are the size of the finished sign. These signs do not utilize longitudinal tubing of any kind, and do not provide a sign wherein the indicia formed by the longitudinal tubing is self supporting. In these signs the indicia is encapsulated within the frame of the sign. This configuration effectively eliminates the visual three dimensional characteristics of a tubular sign, particularly when the sign is viewed from an oblique angle. As will be apparent from the following disclosure these and other shortcomings of the prior art have been overcome by the present invention.

SUMMARY OF THE INVENTION

The present invention relates to the configuration of the longitudinal generally tubular shaped elements utilized in the construction of gas- discharge illumination devices commonly referred to as neon signs or displays. More specifically the invention relates to the alphanumeric or other types of indicia which make up the desired pictorial content of signs or displays. This indicia is formed by manipulation of a gas chamber housing. The housing consists of two sections, each having a longitudinal facial surface configured to match congruently with the longitudinal facial surface of the other to facilitate hermetic joining of the surfaces. The sections are configured to be mass producible, typically by a molding process. The configuration of the sections permits use of any translucent moldable material such as plastics or glass. The molded sections are typically produced separately and joined thereafter. It will be apparent that the sections may be formed in whatever configuration desired. This configuration also permits the addition of electrodes in any desired position by simple modifications in the molding process. The inner and outer housing surfaces may easily be modified to provide special effects by simple modifications to the molds. Extensions of the mating facial surfaces may be provided to increase the strength of the device. These extensions also provide a convenient means for the addition of special effects by modification of the shapes or surfaces thereof. The configuration of the housing as well as the added extensions may be provided with reflective or opaque surface as well as lenses, prisms or other light modifying devices, to facilitate creation a myriad of optical effects. Because of this unique two section longitudinal housing, the above mentioned options can be incorporated before the sections are joined during the initial manufacture of the device. Thus the device may be mass produced with a minimum of effort and a maximum of flexibility of design heretofore not achievable. Accordingly, it is clear that the above mentioned features of the present invention are unique in the art, and do also overcome the shortcomings of the prior art as set forth herein above.

DETAILED DESCRIPTION OF THE INVENTION

Figure 1:
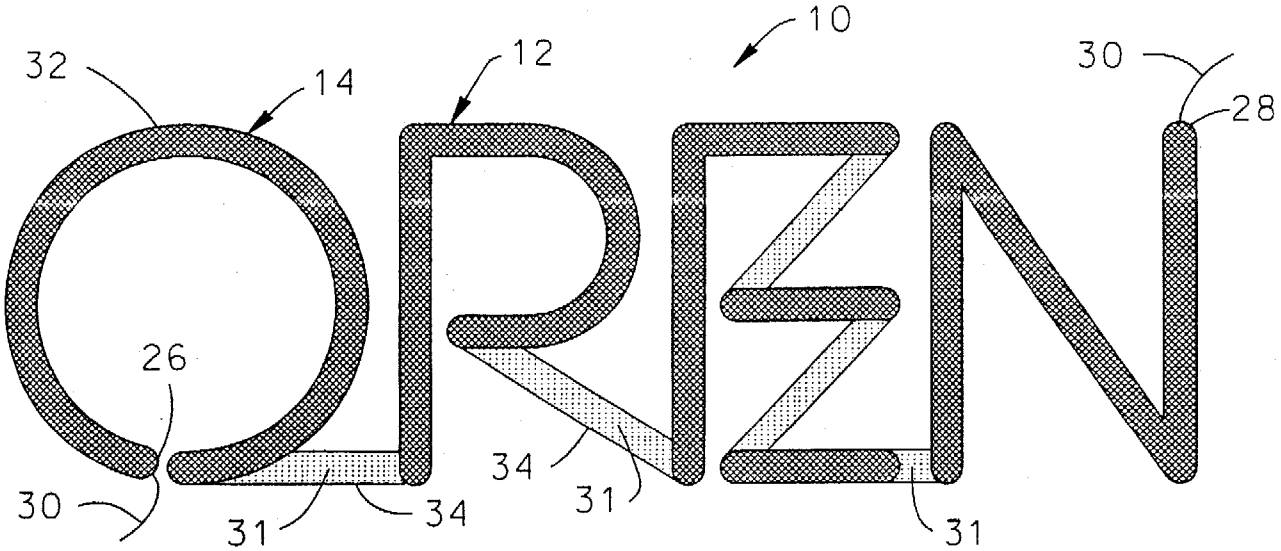
FIG. 1 is an elevational view of a completed gas-discharge sign illustrating a first embodiment of the present invention.
Figure 2:
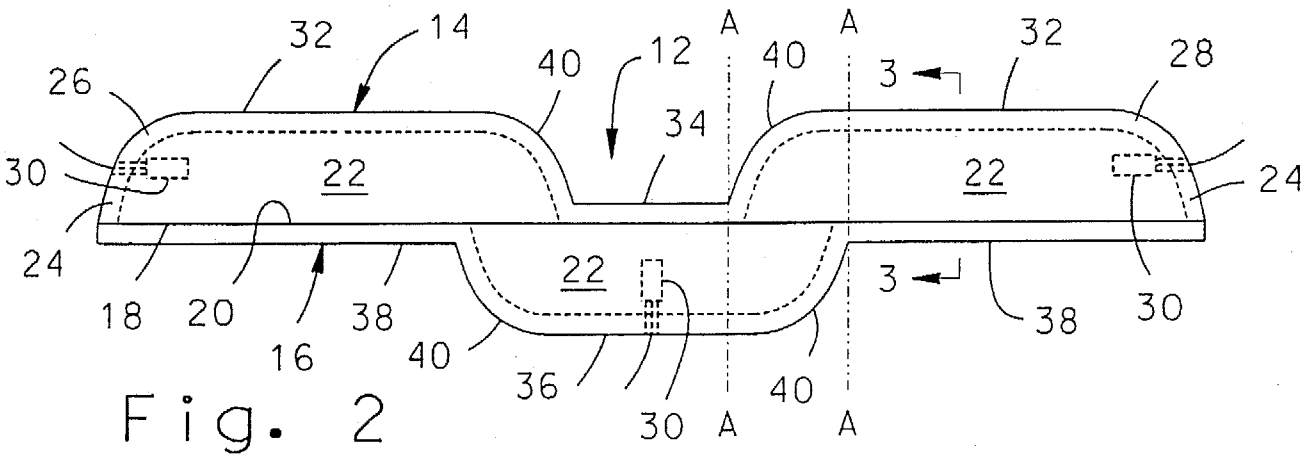
FIG. 2 is an elevational illustration of a simplified example of the configuration of the sign shown in FIG. 1 and wherein like numerals indicate like components. This illustration includes lines A—A which define portions of the sign wherein sections of the device transition from one cross-sectional configuration to another.
Figure 5:
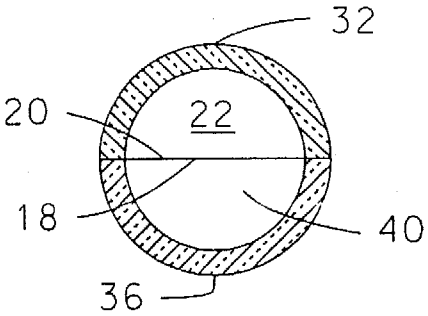
FIG. 5 is a sectional view taken along the line 5—5 of FIG. 4.
Figure 6:
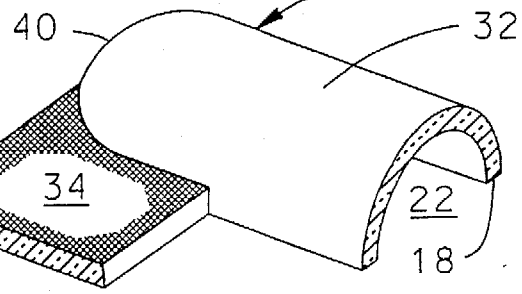
FIG. 6 is an exploded perspective view similar to FIG. 3 wherein the sections illustrated form a right angle turn. The lower section of the illustrated housing shows an example of coatings which may be applied within the gas chamber. The thickness of the coatings are greatly exaggerated for purpose of illustration.
Figure 6:
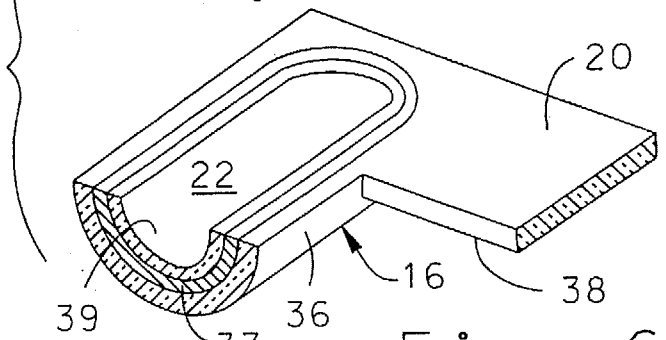
Figure 3:
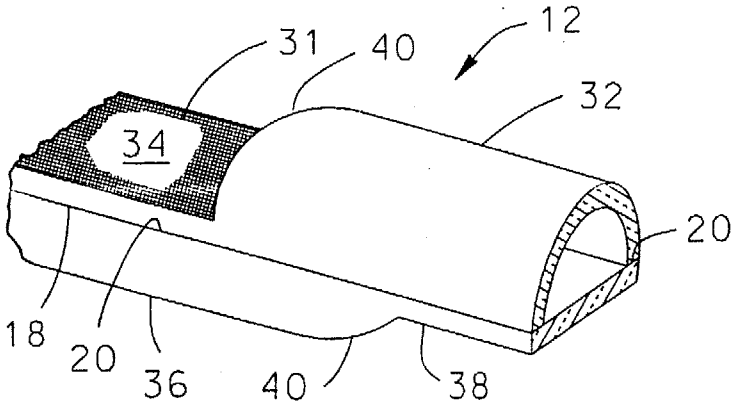
FIG. 3 is a perspective view taken from above of a portion of the device as illustrated in FIG. 2.
Figure 4:
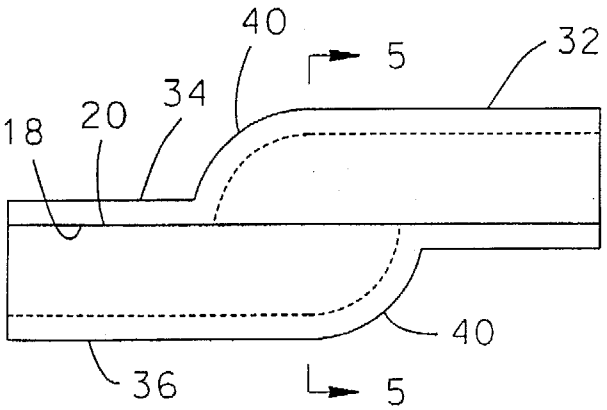
FIG. 4 is an elevational view of the portion of the device as shown in FIG. 3.

Referring now to the drawings, FIGS. 1–6 show one embodiment of a gas discharge illumination device which is the subject of this invention. As shown in FIG. 1, this device is illustrated in the form of an illuminated sign depicting the word "OPEN". The device is referred to generally by the numeral 10. This device is typically made from a translucent material. The device is defined by a gas chamber housing 12. FIG. 2 shows a portion of the housing 12 in a simplified, straight line configuration. That is to say the angularly turned portions such as are apparent in the "OPEN" sign have been straightened for purposes of illustration. As illustrated in FIG. 2, the housing consists of a first section 14 and a second section 16. Each section 14 and 16 includes a facial surface delineated by the numbers 18 and 20 respectively. The sections 14 and 16 are hermetically joined at the facial surfaces thereof by use of adhesives, surface welding or other suitable means. The housing 12 is configured as a longitudinally extending conduit. The housing defines a sealed gas chamber 22 which serves to retain an illuminating gas and as a conduit for the flow of electrical energy for illumination of the gas. The sections 14 and 16 include alternating raised portions and flattened portions. More specifically the section 14 includes raised portions 32 and flattened portions 34 (only one illustrated in FIG. 2) while the section 16 includes raised portions 36 (only one illustrated in FIG. 2) and flattened portions 38. It will be noted that each raised portion of a section is coincident with a flattened portion of the opposing section so as to provide a continuation of the gas chamber 22. It will be readily understood that this continuation of the gas chamber requires a periodic transition in each of the sections from a raised portion to a flattened portion or from a flattened portion to a raised portion. Accordingly, a transition segment 40 (that portion between definition lines A—A) is defined to accomplish this transition. Each of the sections 14 and 16 is formed as a continuous, integral entity, and the transition segments therein are not separable portions but rather are described as such only as an aid to description of the device. The sections 14 and 16 may be provided with a closure 24 which is formed at each end 26 and 28 of the housing 12 by the continuation of the hermetically joined facial surfaces 18 and 20. It will be understood that typically an end such as 24 would be utilized on which ever of the sections 14 or 16 is concluded with a raised portion. Electrode assemblies 30 are typically provided on each end of the housing 12 and when provided with electrical power (electrical supply not shown) serve to ignite an illuminating gas which is contained within the gas chamber 22. An important feature of the invention is the fact that operations which are difficult to accomplish within a typical cylindrical neon sign are easily accomplished during construction of the two section device as herein described. An example of this feature is the inclusion of an additional electrode in the raised portion 36 as illustrated in FIG. 2. It will be readily understood that any number of electrodes may be placed within either section 14 or 16 during the construction thereof since the interior of the chamber is open for access before the sections are joined. As best illustrated in FIGS. 1–6, the raised portion of this embodiment is configured as an arch. It will be understood that the configuration of the sections 14 and 16 may be modified to achieve a variety of effects for display in resulting illuminated signs. As illustrated in FIG. 1, the first section 14 is typically configured to form the frontal portion of an illuminated display. It will be appreciated that in such a configuration only the raised portions 32 are illuminated. Of particular importance is the fact that the illuminated raised portion provide an outstanding three dimensional effect when the sign is viewed from any oblique angle. It will be further noted that flattened rearward sections 38 are not apparent from such a point of view. It is apparent also that use of the flattened rearward section provides a more efficient configuration than that of a tubular glass sign in that the ineffective semi-circular rearward portion of a tube has been eliminated thus reducing the amount of gas required for a given illuminated area. Referring now to FIG. 3 it will be noted that the perspective view of the illustrated portion of the housing 12 reveals that the outer surface 31 of flattened portion 34 is opaque. While the rearward section of the "OPEN" sign of FIG. 1 would typically be opaque in its entirety, several such opaque surfaces are also shown as darkened portions of the frontal or visible section of the sign. In relating the FIGS. 2–5 to the "OPEN" sign of FIG. 1 it will be understood that only the frontal section 14 is visible when viewing the sign from the front. Accordingly, it will be understood that the surface 31 of each flattened portion 34 of section 14 will typically be opaque. Thus the light emitted for view from the front of the sign will pass only through the raised portion 32 of the section 14. As best illustrated in FIGS. 1 and 2, it will be seen that the entire section 16 is positioned congruently behind the section 14 and is therefore not visible from the front. To avoid reflected light from behind the sign, the rear section which in this case is section 16, is typically totally opaque. FIGS. 4 and 5 further illustrate the fact that with appropriate sizing the cross-sectional area of the gas chamber 22 remains generally constant within the transition areas and through out the length of the housing 12. While illustration of the configuration of the several turns made by the gas chamber housing 12 as it defines the letters of the sign 10 is not practical, FIG. 6 illustrates the configuration of a typical ninety degree turn. It is apparent from this illustration that turns of other angles may be formed by simple changes of the gas chamber angles. The simplicity and effectiveness of such a turn becomes apparent when compared to a typical tubular glass sign wherein in many cases the tube must form two ninety degree turns to provide a similar change in direction. Also illustrated in FIG. 6 is an example of the use of various coatings within the gas chamber 22. The thickness of the coatings are greatly exaggerated for purposes of illustration. A single coating such as 37 is typical. This coating may be formed from many types of material in accordance with the special effects to be displayed. As examples, the coating may be a pigmented phosphorescent substance, an opaque substance, a reflective substance or other desired substances. A second coating 39 may be required in some applications. For example, if an electrically conductive reflective substance is to be used as coating 37, an electrically non conductive, transparent covering 39 may be utilized to prevent undesirable electrical conditions within the gas chamber 22. These coatings are easily applied prior to assembly of the sections 14 and 16.

Figure 7:
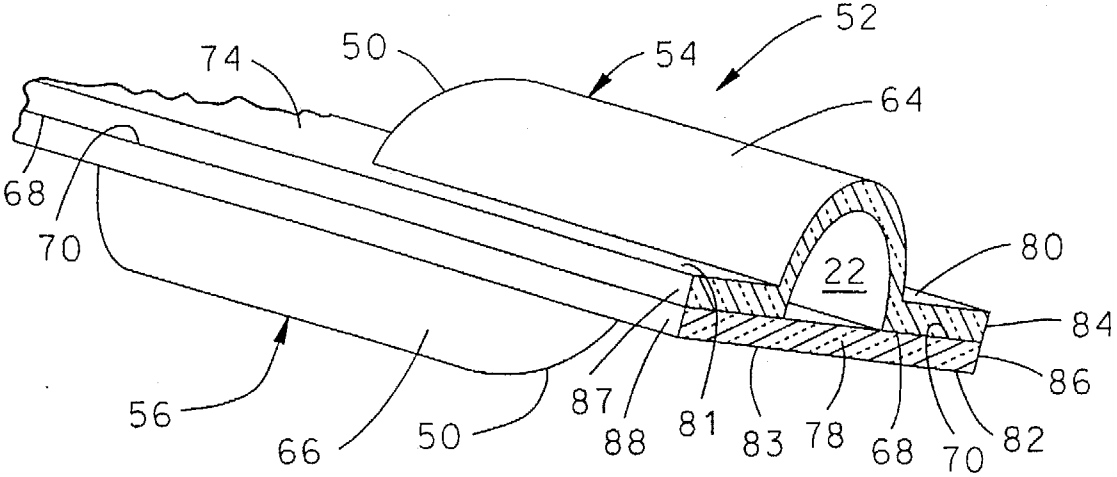
FIG. 7 is a perspective view similar to FIG. 3 of a section of a second embodiment of the device.
Figure 8:
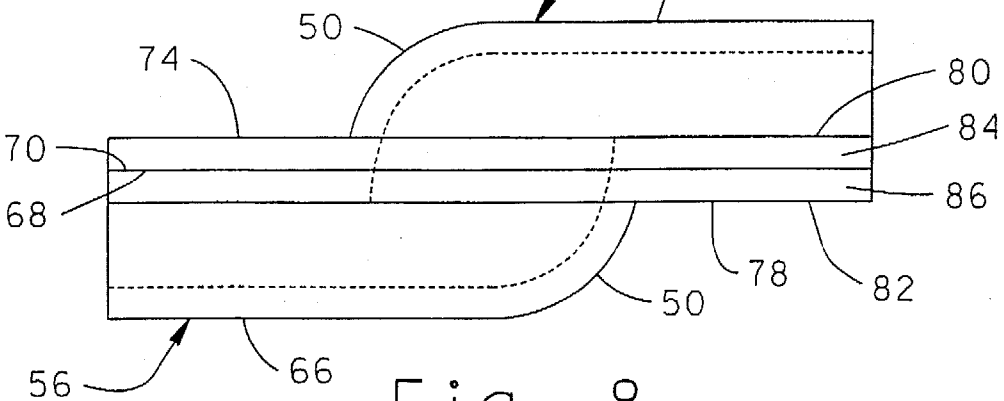
FIG. 8 is an elevational view of the device illustrated in FIG. 7.
Figure 11:
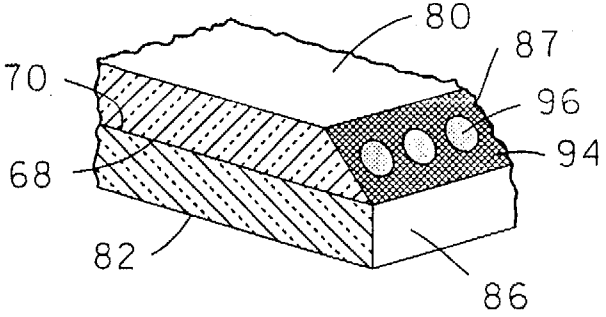
FIGS. 11 and 12 are broken away illustrations showing special effects configurations on the edge portions of the embodiment of FIG. 7.
Figure 12:
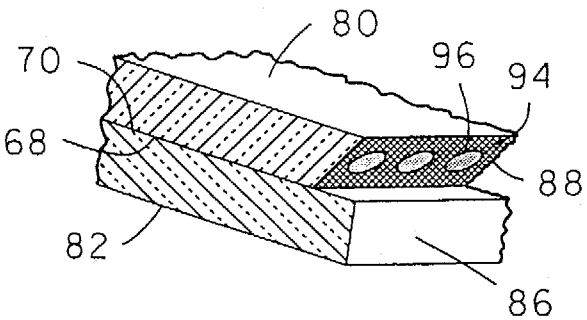
Figure 9:
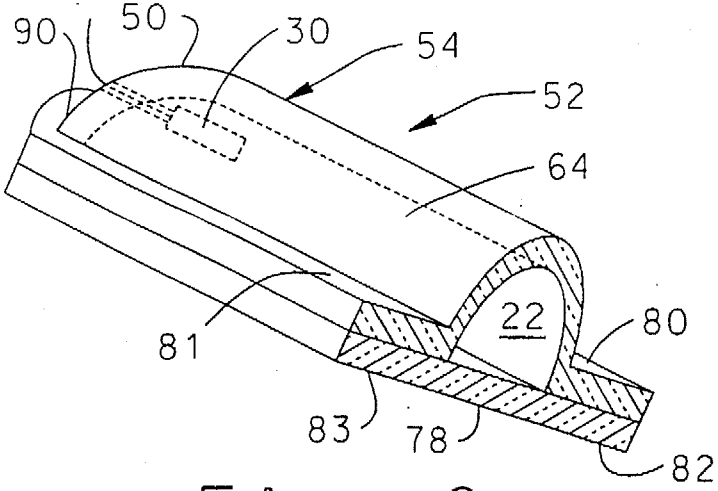
FIG. 9 is a perspective view of the embodiment illustrated in FIGS. 7 and 8 and showing an end closure portion of the device.
Figure 10:
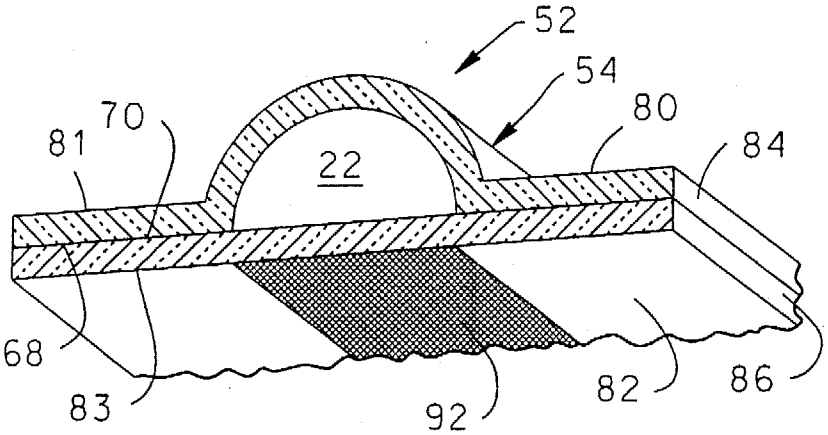
FIG. 10 is a perspective view of a portion of the embodiment of FIG. 7 and showing an opaque portion on the bottom thereof.

Another embodiment of the invention is depicted in FIGS. 7 through 12. As best illustrated in FIG. 7, the gas chamber 22 is formed in the same manner as in the first embodiment illustrated in FIGS. 1 through 6. More specifically a first section 54 includes a raised portion 64, a flattened portion 74 and a facial surface 68. A second section 56 includes a raised portion 66, a flattened portion 78 and a facial surface 70 which is hermetically joined to the facial surface 68. This embodiment is provided with facial extensions on each side of gas chamber housing 52. More specifically a facial extension 80 extends laterally outwardly from the raised portion 64 and terminates at a distal edge 84, while a similar facial extension 82 extends laterally outwardly from the flattened portion 78 and terminates in a similar fashion at distal edge 86. On the opposite side of the gas chamber housing 52 facial extensions 81 and 83 as well as the respective edges 87, 88 are formed in like manner. It will be noted that the facial extensions are in all cases an extension of the facial surfaces which serve to hermetically join the sections 54, 56. It will be seen that the extensions provide added structural strength to the entire device as well as a greatly enlarged sealing area. An illustration of a terminal end or closure 90 of this embodiment is provided in FIG. 9. FIG. 10 shows a typical use of an opaque coating on an outside surface 92 in accordance with this embodiment of the invention. It will be understood that the surface 92 may also be provided with a reflective coating designed to reflect the light rays within the chamber upwardly to increase the brightness of the gas chamber housing. In addition to the structural advantages provided by the facial extensions, the extensions provide a means for providing numerous options for creating unique lighting displays. For example, it will be readily understood that when the gas chamber housing is illuminated, the illumination will be channeled throughout the facial extensions and particularly to the edges thereof, thus providing a pleasing illuminated trim around the entire gas chamber housing. As illustrated in FIGS. 11 and 12 the edges of the facial extensions provide additional options for special lighting effects. As illustrated in FIG. 11, the edge portion 94 is tapered angularly away from the edge portion 86. A reflective coating 94 serves to reflect incident light rays back into the facial extension 80 to provide a diffused but brightened light along the edges of the facial extension 80. Additional special effects are achieved with the provision of either concave or convex surface variations such as illustrated by the numeral 96. These surface variations may also take the form of lenses, prisms, etchings or other configurations. If a brighter border trim lighting is desired the edge 84 is tapered angularly opposite to that of FIG. 11. This configuration is shown in FIG. 12. It is apparent that this configuration will serve to reflect incident light rays outwardly so as to brighten the outer-surface of the facial extension adjacent the edge to a greater degree than that of the diffused reflection as in the configuration illustrated in FIG. 11. It is apparent that the facial extensions illustrated in this embodiment provide an infinite number of special effect options. For example any surface of the extensions may be etched to provide what ever artistic configuration may be desired.

Figure 13:
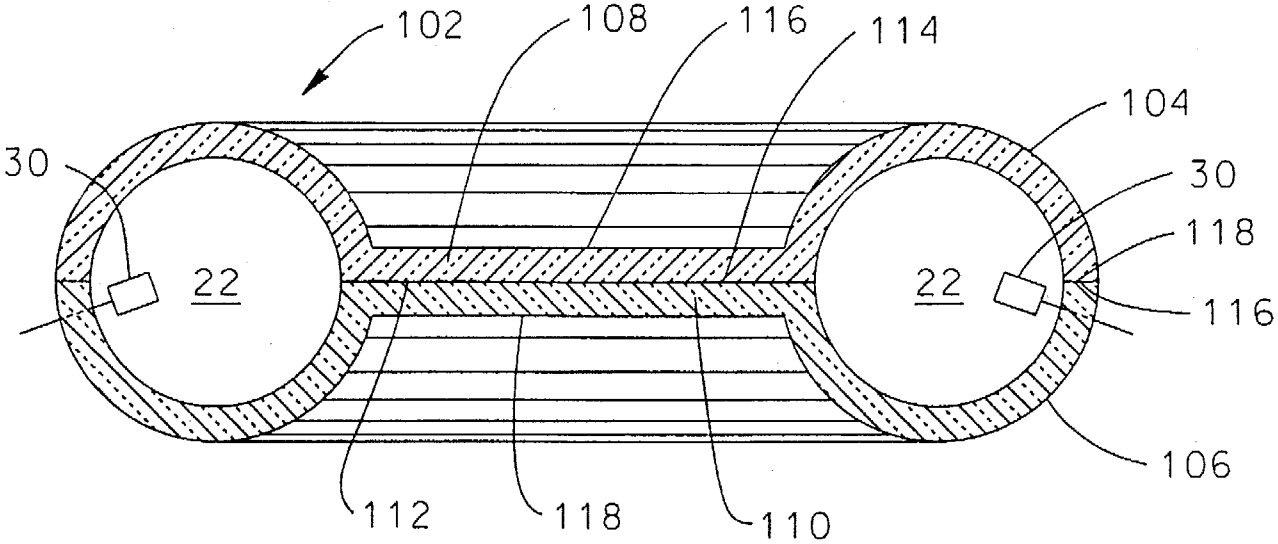
FIG. 13 is a section taken on a diameter of a third embodiment of the device wherein the device is configured as a torus.
Figure 15:
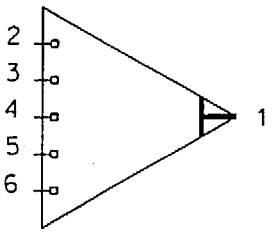
FIG. 15 is an illustration of the location of electrodes used in a triangular gas chamber for special effects.
Figure 14:
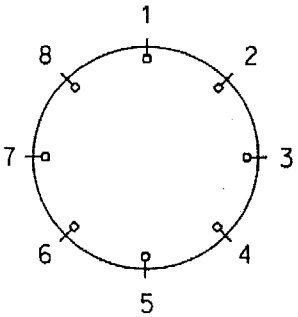
FIG. 14 is an illustration of the location of electrodes used in a circular gas chamber for special effects.

A third embodiment of the invention is depicted in FIG. 13. As illustrated therein the gas chamber housing 102 is configured as a toroid and is formed by a semi-circular first section 104 which is hermetically joined to an identically formed second section 106 at radially inner facial surfaces 112 and 114 of radially inner facial extensions 108 and 110 respectively. The first and second sections 104 and 106 are also hermetically joined by radially outer facial surfaces 116 and 118 respectively. Electrode assemblies 30 are provided for ignition of an illumination gas within chamber 22. Of particular interest are the closed surfaces 116 and 118 of the radially inner facial extensions 108 and 110 respectively. The surfaces 116 and 118 provide a format for artistic etching. As is readily understood the light from within the gas chamber 22 will illuminate the surfaces 116 and 118 whereby etchings in the surfaces will be pleasingly highlighted. In addition to the conventional illumination by the electrode assemblies 30, the gas chamber 22 may be illuminated by sequentially actuated electrode assemblies such as are illustrated schematically in FIG. 14 wherein the electrode assemblies 1 through 8 may be ignited in any desired sequence to provide selected lighting effects. The electrodes 1 through 8 have been individually numbered in schematic drawings FIGS. 14 and 15 to make clear the sequential operation thereof. As indicated schematically in FIG. 15 the cross-sectional configuration of the gas chamber housing may be varied to meet whatever effects desired. In this illustration an electrode 1 is located at the apex of the triangle and is actuated in desired sequences with respect to the electrode assemblies 2–6.

It is clear from the above description that the lighting effects which may be easily accomplished by use of the present invention are unlimited. In this regard it is noted that the invention permits the use of electrodes in any portion of the sections during the molding process. The surface configuration of either section of the housing may be determined by simple modifications to the mold in which the section is to be formed. The strength and flexibility of the device may be simply controlled by the use of suitable materials and by relatively minor changes to the mold in which the section is to be formed. And most importantly after the initial preparation of the molds, identical sections may be mass produced.

Accordingly it is understood that preferred embodiments of the present invention are disclosed which achieve the objectives of the invention as set forth above. However, it should be appreciated that this invention may be implemented in forms other than those disclosed. Variations may also be made with respect to the best mode of practicing this invention without departing from the scope of the invention as set forth in the appended claims.

I claim:

1. A gas-discharge illumination device comprising: a translucent longitudinally extending housing forming a gas chamber, said housing having a first section and a second section, each said first and second sections having a mating facial surface, each said mating facial surface hermetically attached to the other, said first and second sections having a plurality of longitudinally extending raised portions each having a predetermined cross-section, a plurality of longitudinally extending flattened portions each having a predetermined cross-section and a plurality of longitudinally extending transition segments, the longitudinally extending cross section of each said transition segment transitioning from the cross-sectional configuration of each said raised portion to the cross-sectional configuration of each said flattened portion, said raised portions of said first section being coincident to said flattened portions of said second section, said raised portions of said second section being coincident to said flattened portions of said first section, said transition segments of said first section being coincident to the transition segments of said second section so as to form said gas chamber between said first and second sections as a longitudinally extending conduit having a generally constant cross-sectional area; and illumination means for illuminating said gas chamber and said housing.

2. A device as set forth in claim 1, wherein said illumination means includes a plurality of electrodes strategically positioned within said gas chamber housing, and wherein said electrodes are sequentially powered to provide selected illumination effects.

3. A device as set forth in claim 1 wherein portions of said sections are provided with an opaque surface to permit illumination by said gas chamber only in selected areas, and wherein said first section is disposed to form the frontal portion of said illuminated display, and wherein said selected areas of said first section include only said raised portions of said first section.

4. A device as set forth in claim 1 wherein portions of one of said first and second sections are provided with a reflective surface to provide special effects to the illumination of said gas chamber.

5. A device as set forth in claim 4 wherein said reflective surface is formed on said housing within said gas chamber.

6. A device as set forth in claim 5 wherein a transparent, electrically non conductive coating is provided between said reflective surface and said gas chamber.

7. A device as set forth in claim 1 wherein each said section further includes an extension extending laterally outwardly therefrom in congruent relation with one another and terminating at a distal edge, each said extension providing a continuation of each said facial surface of each said section.

8. A device as set forth in claim 7 wherein at least one said distal edge is formed as an angle with respect to the facial surface of each said extension.

9. A device as set forth in claim 7 wherein at least one said distal edge includes at least one surface indicia thereon.

10. A device as set forth in claim 1 wherein the cross-sectional configuration of said raised portions are generally configured as an arch, and the cross-sectional configuration of said flattened portions are generally configured as a flattened plate.

* * * * *